US006305765B1

(12) United States Patent
Park

(10) Patent No.: US 6,305,765 B1
(45) Date of Patent: Oct. 23, 2001

(54) APPARATUS FOR OPENING AND CLOSING SLIDE DOOR FOR CONTROL BOX

(75) Inventor: Jae-Hoo Park, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/431,259

(22) Filed: Nov. 1, 1999

(30) Foreign Application Priority Data

Oct. 30, 1998 (KR) ..... 98-46005

(51) Int. Cl.[7] ..... A47B 97/00

(52) U.S. Cl. ..... 312/223.1; 49/213; 312/306

(58) Field of Search ..... 312/223.1, 306, 312/312, 319.5, 319.6, 319.7, 319.8; 220/385, 345.1, 345.2, 345.4, 351; 49/213, 209, 336, 337, 362, 425

(56) References Cited

U.S. PATENT DOCUMENTS 5,271,181 * 12/1993 Pietro ..... 49/213 X
5,924,780 * 7/1999 Ammon et al. ..... 312/306 X
6,062,663 * 5/2000 You et al. ..... 312/306 X

* cited by examiner

*Primary Examiner*—Peter M. Cuomo
*Assistant Examiner*—Michael J. Fisher
(74) *Attorney, Agent, or Firm*—Sughrue, Mion, Zinn, Macpeak & Seas, PLLC

(57) ABSTRACT

A slide opening and closing door apparatus for a control box is provided, in which a cover portion of a slide door opens and closes an exposed button portion of the control box which is located in the substantially same vertical surface as that of a front panel. The control box slide opening and closing door apparatus includes a guide unit in which a vertically elongate hole is formed in an inner wall of each side of the control box, a door member which moves up and down along the guide unit in order to open and close the upper portion of the control box, and a power transmission unit for transmitting power to the door member. In this manner, the door which is transferred by the driving of the electric motor ascends and descends in the control box, to thereby cover a button portion in the control box appropriately.

17 Claims, 10 Drawing Sheets

APPARATUS FOR OPENING AND CLOSING SLIDE DOOR FOR CONTROL BOX

BACKGROUND OF THE INVENTION

1. Field of the Invention

The present invention relates to an apparatus for opening and closing a slide door for a control box, and more particularly, to a slide opening and closing door apparatus for a control box in which the cover of the slide door is positioned on the same vertical surface as that of a front panel without any step difference.

2. Description of the Related Art

A control box can be positioned in the front panel of a consumer electronics product such as air-conditioners. In the case of this type of consumer electronics products, a button portion in which a number of buttons are collected in the control box is opened and closed by a slide door so that the number of buttons are to be manipulated from the front side. As shown in FIG. 2, a conventional slide door employs a vertical movement structure using an electric motor in which a step difference $\alpha$ occurs between the slide door and the cover portion. The step difference becomes a critical problem in the consumer electronics products requiring a more elegant external design.

SUMMARY OF THE INVENTION

To solve the above problem, it is an object of the present invention to provide a control box slide opening and closing door apparatus in which a button portion where a number of buttons are positioned in a control box is covered by a door during closing without any step difference with respect to a front panel and the door is hidden behind the cover of the control box during opening.

To accomplish the above object of the present invention, there is provided a slide door opening and closing apparatus for a control box comprising a control box having a button portion on which a number of buttons are positioned and a cover for covering the inner space of the control box, a door member which moves up and down from the inner side of the cover, for opening and closing the button portion on the control box, and a power transmission unit for providing power to the door member to be moved up and down.

A guide elongate hole is formed at the inner wall in each side of the control box. The door member is guided along the guide elongate holes. Here, the button portion forms a sliding surface at each side thereof. A guide elongate hole is slanted at a predetermined interval. The door member can be configured by comprising a cover portion which moves up and down from the rear end of the cover of the control box for opening and closing the button portion and a transfer unit for receiving power and performing a transferring operation.

The door member according to the present invention is sectioned into a door and a transfer unit both of which independently operate.

Here, the control box forms a space which is covered in the front surface of the lower side thereof and a button portion which is exposed in the upper side thereof. A guide elongate hole is formed at the inner wall in each side thereof. The button portion forms a sliding surface at each side thereof.

In particular, the guide elongate holes are slanted at a predetermined interval so that a door member can proceed without any step difference. The door member forms a guide protrusion at each side thereof so that the door member can move up and down from the rear end of the cover of the control box in order to open and close the button portion. The door member forms connection units at its rear side and a support plate which has a step difference and extends at a low posture at its lower side thereof.

The transfer unit comprises connection units which are flexibly connected with the door member, guide pieces which move up and down along the guide elongate holes, and rack gears which connect with pinion gears of the power transfer unit. The door member and the transfer unit form connection units facing each other, respectively. Links are connected between the connection units. Also, the transfer unit descends and ascends in balance during contacting the door member and further comprises elastic members for supporting the bottom surfaces of the support plates elastically. The door member forms contact protrusions which contact the slide surfaces of the button portions at its rear surface.

The power transmission unit is configured by connecting a motor to a worm which is formed on the rotational shaft of the motor, worm gears which are engaged to the worm interposed therebetween, and idle gears and pinion gears which are engaged with the worm gears and the rack gears of the transfer unit.

BRIEF DESCRIPTION OF THE DRAWING

The above object and other advantages of the present invention will become more apparent by describing the preferred embodiment thereof in more detail with reference to the accompanying drawing in which.

DETAILED DESCRIPTION OF THE PREFERRED EMBODIMENT

A preferred embodiment of the present invention will be described below with reference to the accompanying drawings.

Figure 1:
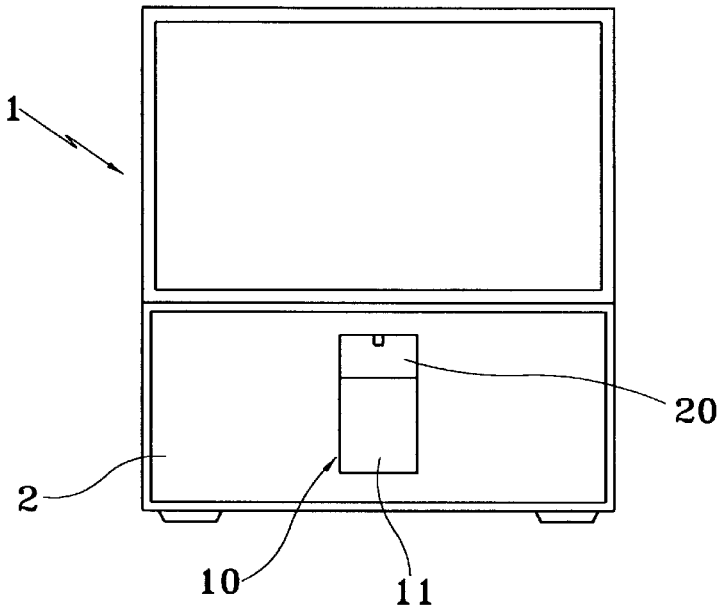
FIG. 1 shows an example of a consumer electronics product on which a control box is applied.
Figure 2:
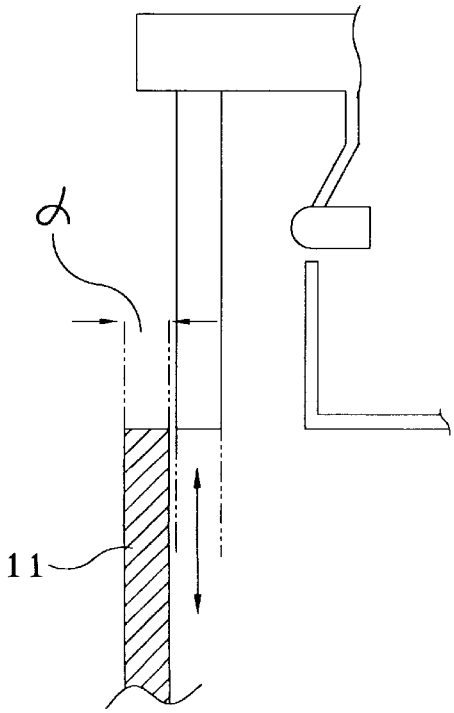
FIG. 2 is a side sectional view for explaining a slide door opening and closing state in a conventional control box.

In FIG. 1, a conventional consumer electronics product 1 employing a control box 10 is shown. In FIG. 1, the control box 10 is located in the center of a lower front panel 2, in which a door 20 located above a lower cover 11 is closed.

Figure 3:
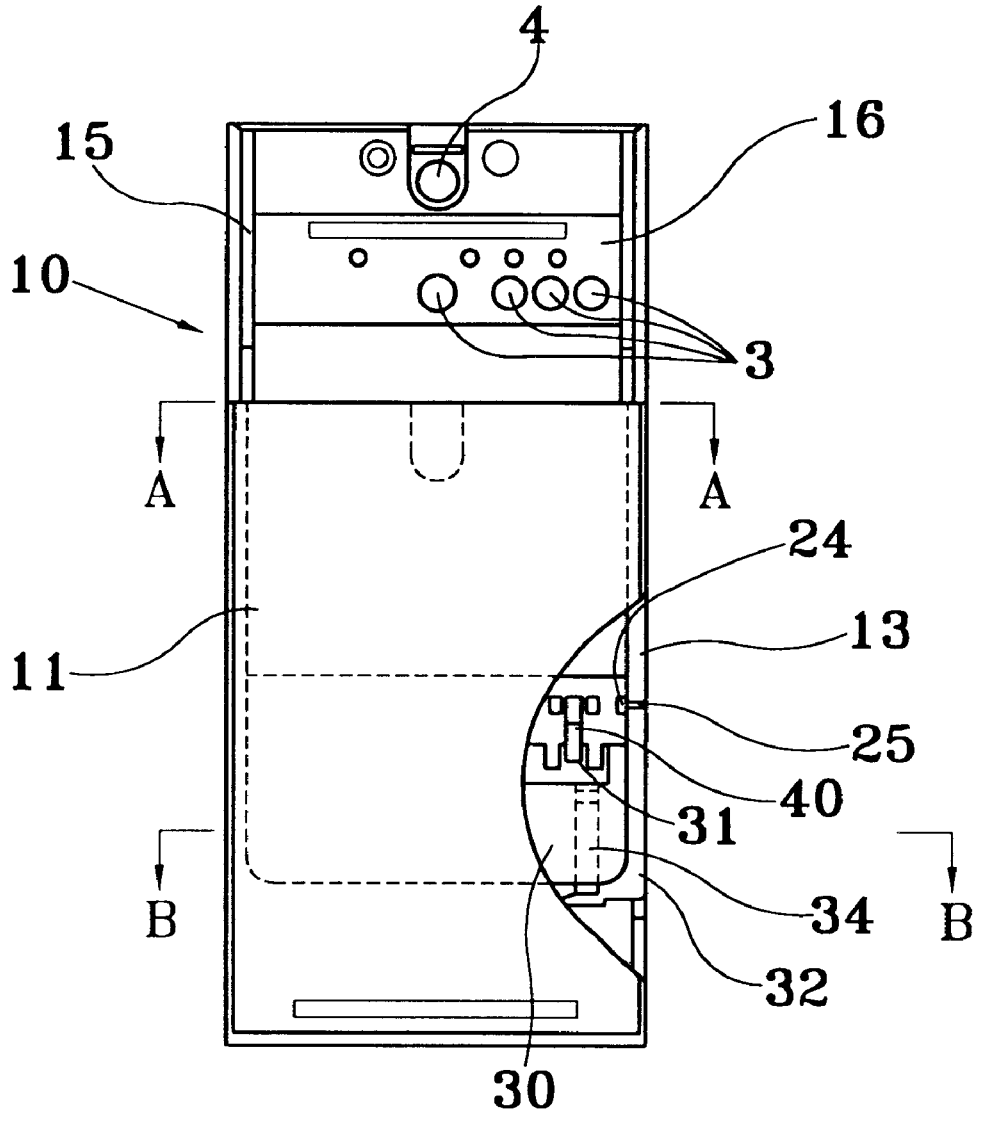
FIG. 3 is a partially exploded front view of a control box accog to the present invention.

FIG. 3 is a front view of a control box according to the present invention, which shows that a door is opened. In FIG. 3, part of a cover 11 has been exploded. FIG. 3 shows a rear side of the cover 11 showing that guide protrusions 25 and guide pieces 32 according to the present invention are located on guide elongate holes 13.

Figure 4:
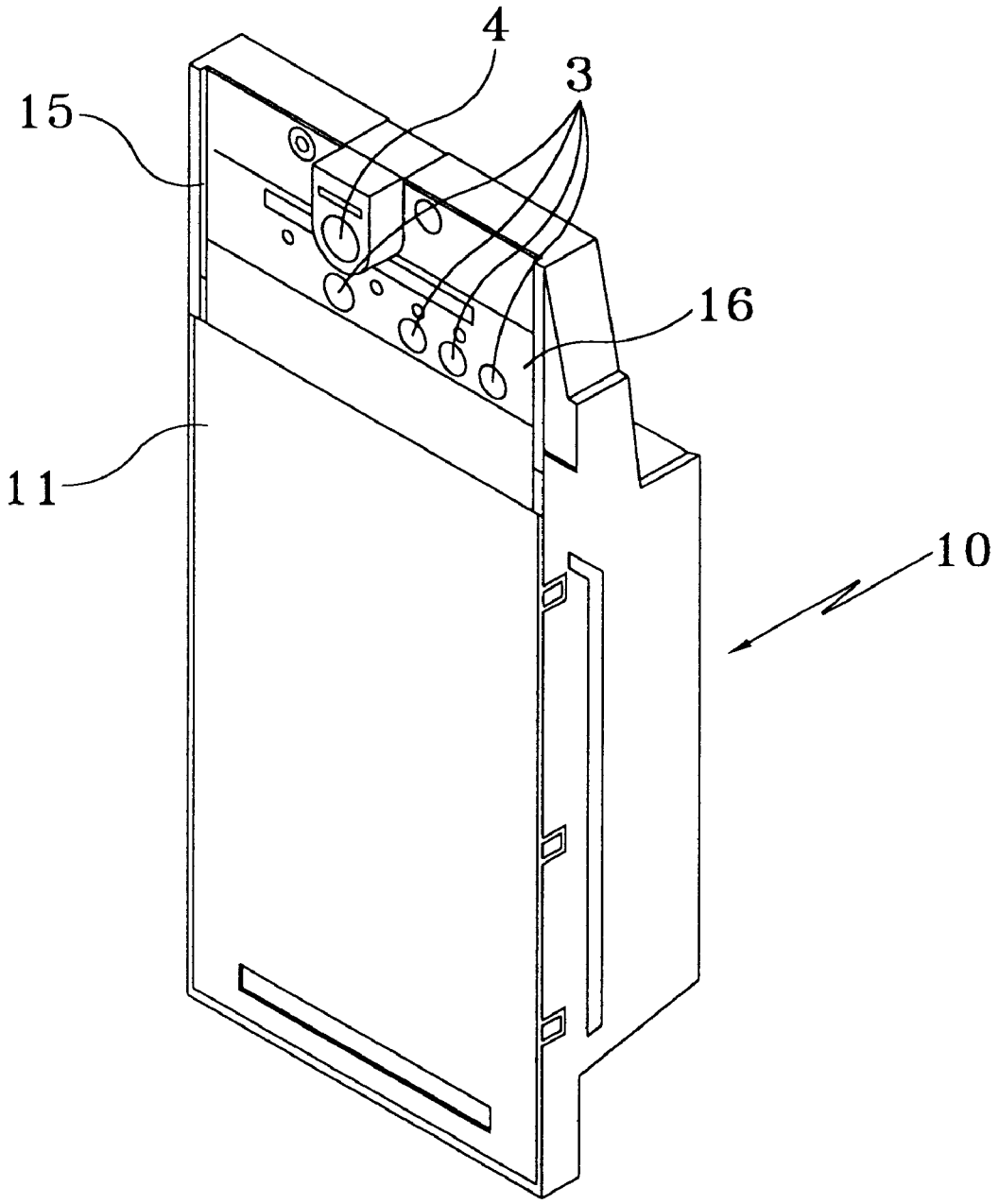
FIG. 4 is a perspective view of the control box according to the present invention.
Figure 5:
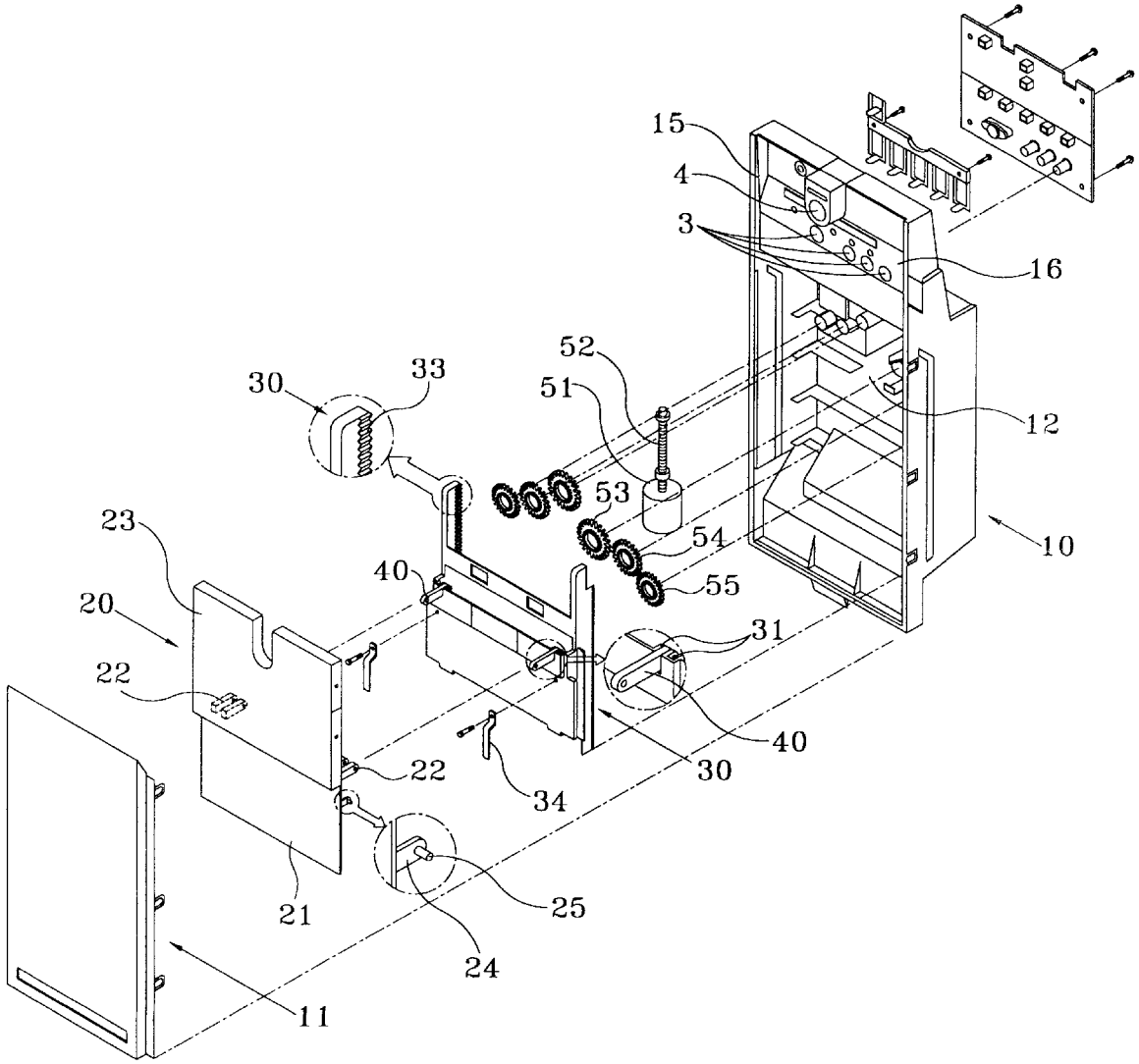
FIG. 5 is an exploded perspective view of the control box according the present invention.

FIG. 4 is a perspective view of the control box according to the present invention. FIG. 5 is an exploded perspective view of the control box according to the present invention. Referring to FIGS. 4 and 5, the whole structure of the control box according to the present invention will be described below.

A control box 10 is a substantially rectangular box whose front surface is opened and rear surface forms a bottom 12. The upper portion of the bottom 12 in the control box 10 forms a button portion 16 which is protrudingly formed. Switching buttons 3 and an opening and closing button 4 for operating the door 20 are formed on the button portion 16. Sliding surfaces 15 are formed in both sides of the button portion 16. A connection member and a printed circuit board (PCB) are installed in the rear surface of the button portion 16 on which the buttons 3 and 4 are located, in which the buttons 3 and 4 are connected to the PCB via the connection member. A pair of guide elongate holes 13 (see FIG. 6A) are formed on the inner walls in both opened sides of the control box 10. The upper portion of each guide elongate hole 13 is inclined to form a slant portion 14, and the lower portion thereof is linear (see FIG. 6A). A door 20, a transfer unit 30 and a power transmission unit 50 are installed on the lower opened bottom 12 of the control box 10. The power transmission unit 50, the transfer unit 30 and the door 20 are installed in turn from the inner side thereof and then the cover 11 is assembled, to thereby complete the installation.

The button portion 16 on which the buttons 3 and 4 are exposed from the cover 11 is closed or opened by the door 20 which moves up and down from the rear side of the cover 11.

Referring to FIG. 5, the door 20 for opening and closing the control box 10 opens and closes the button portion 16 on which the buttons 3 and 4 are formed and has a certain shape extended from the button portion 16.

Figure 6A:
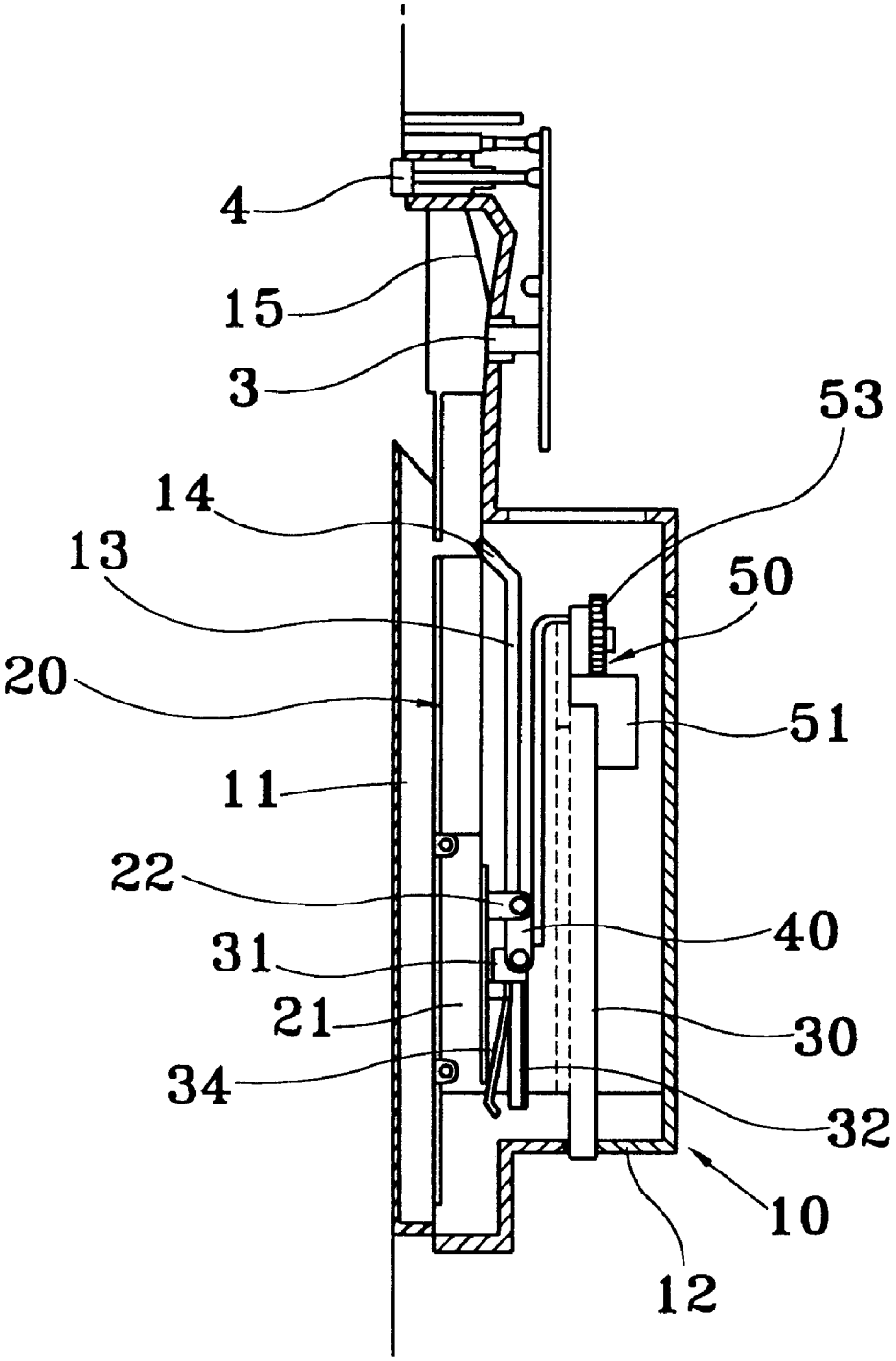
FIGS. 6A through 6D are views for explaining the vertical movement of the door member according to the present invention.
Figure 6B:
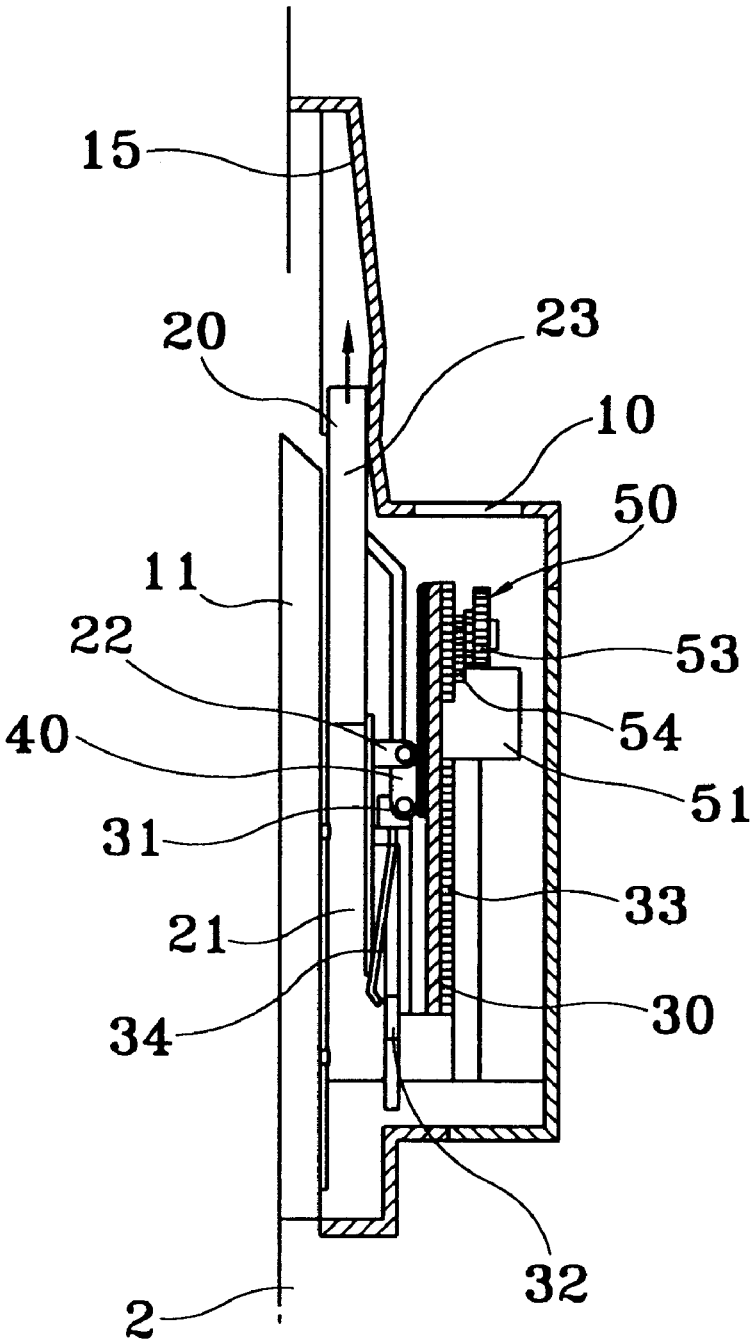
Figure 7A:
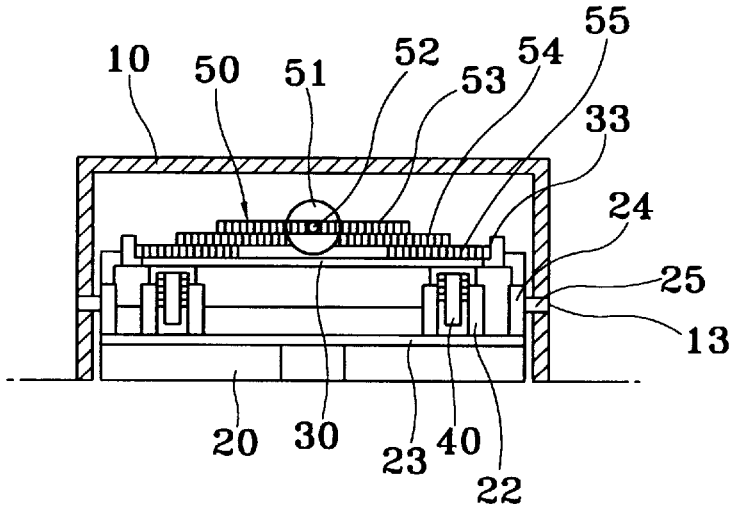
FIGS. 7A and 7B are horizontal sectional views of the line A—A of FIG. 3 which show the position at which the power transmission unit and the transfer unit have been installed.
Figure 7B:
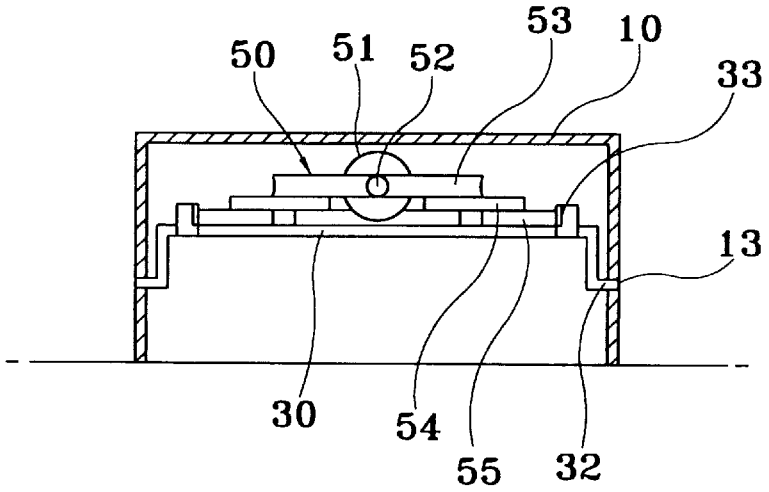
Figure 8:
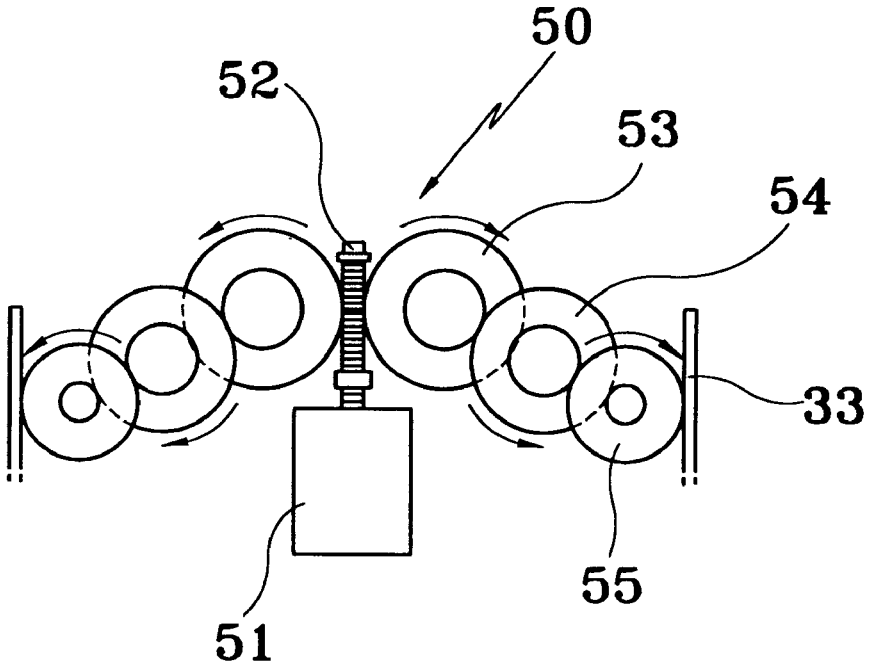
FIG. 8 is a partially exploded front view showing the position where the power transmission unit according to the present invention has been installed.

That is, as shown in FIG. 6B, the upper portion of the door 20 forms a cover portion 23 which protrudes by a predetermined length as it can be seen from the side surface, and the lower portion thereof forms support plates 21 while having a step difference from the cover portion 23. On the rear surface of the door 20 are formed connection units 22 which are connected to the transfer unit 30, and guide protrusions 25 which are slid at both sides along the guide elongate holes 13 of the control box 10. The guide protrusions 25 are protruded laterally from protruding pieces 24 which are located on the rear side of each support plates 21, as shown in FIG. 7A. Also, the door 20 contacts the sliding surface 15 of the control box 10 when the door 20 moves up and down. Here, the cover portion 23 maintains the state of contacting the sliding surface 15 since the support plates 21 are subject to receive an elasticity due to elastic members 34 of the transfer unit 30.

The transfer unit 30 which is connected to the rear side of the door 20 forms connection units 31 corresponding to the connection units 22 of the door 20. Links 40 are connected between the connection units 22 and 31, to thereby enable the door 20 to move along a limited length on the front surface of the transfer unit 30. The two elastic members 34 are installed in both lower sides of the connection units 31. The elastic members 34 support the support plates 21 of the door 20 elastically. A plate spring is appropriately used as the elastic member 34.

Guide pieces 32 are formed in both sides of the edges in which the connection units 31 of the transfer unit 30 are located, and located on the guide elongate holes 13 together with the guide protrusions 25. On both rear sides of the transfer unit 30 are formed rack gears 33 for receiving the power of a motor 51 to be described later. Both the rack gears 33 are engaged with pinion gears 55 of the power transmission unit 50 to receive the power.

As shown in FIGS. 5, 7A, 7B and 8, the power transmission unit 50 has a gear structure for providing the same torque to both sides around the single motor 51. That is, the vertical shaft of the motor 51 is connected to a worm 52. Both sides of the worm 51 are connected to worm gears 53, idle gears 54 and pinion gears 55, in turn. The pinion gears 55 are connected to the rack gears 33 of the transfer unit 30.

Referring to FIGS. 6A through 6D, the vertical movement of the present invention will be described.

Figure 6C:
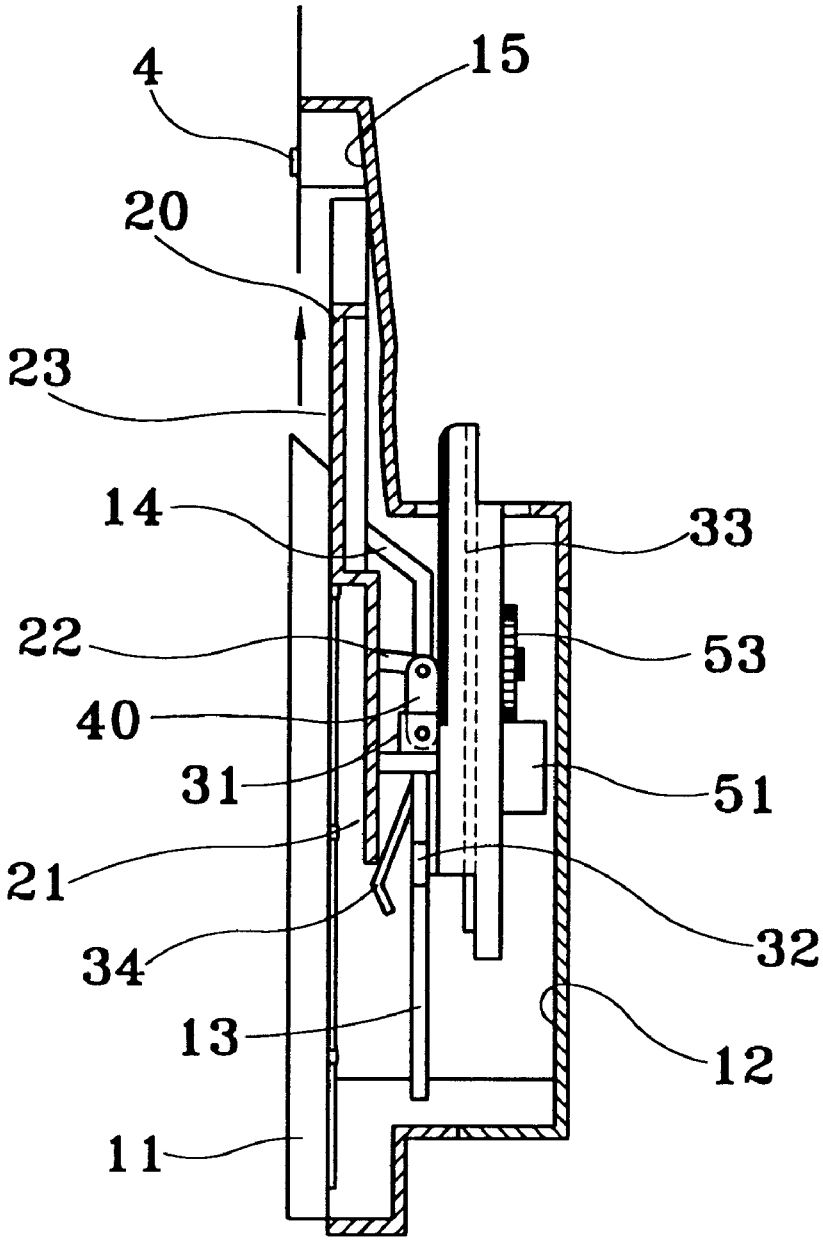
Figure 6D:
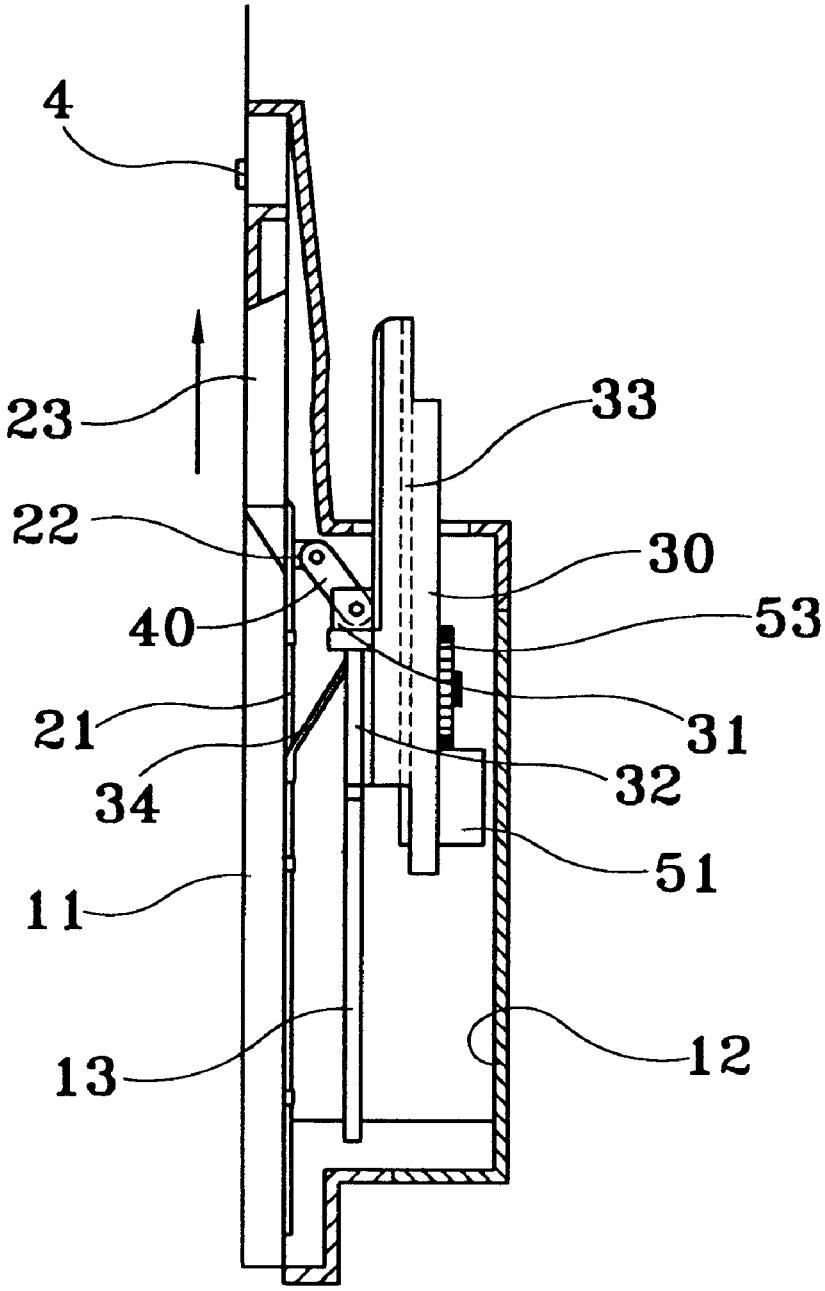

That is, FIG. 6A is a sectional view which is taken by laterally cutting FIG. 4, showing the position where the door is opened. FIG. 6B shows the initial time when the door 20 ascends. FIG. 6C shows the middle time when the door 20 ascends. FIG. 6D shows the last time when the door 20 ascends, showing the position where the door 20 has been completely closed.

In FIG. 6D showing the state where the door 20 has been closed, the button portion 16 is covered with the door 20, in which state the exposed opening and closing button 4 is pressed. The motor 51 is driven by the operation of the opening and closing button 4. The worm gears 53, the idle gears 54, and the pinion gears 55 in the power transmission unit 50 are in turn rotated by the driving of the motor 51, to thereby descending the rack gears 33. By the descending of the rack gears 33, the transfer unit 30 starts to descend and at the same time the door 20 starts to descend. In the case of the door 20 before descending, the guide protrusions 25 are located at the slant portion 14 of the guide elongate holes 13 and the guide pieces 31 of the transfer unit 30 are located in the vertical section of the guide elongate holes 13, at the state where the cover portion 23 closes the button portion 16. When the transfer unit 30 continuously descends, the door 20 connected to the link 40 passes through the slant portion 14 in sequence of FIGS. 6C and 6B and vertically descends in the linear section. When the door 20 descends, the cover portion 23 disappears gradually behind the cover 11. Here, the descending door 20 descends without any shaking at its lower side by means of the elasticity of the elastic members 34 which are elastically installed toward the door 20 from the transfer unit 30. Thereafter, the door 20 is completely opened at the descending closing time as shown in FIG. 6A, in which case the door 20 disappears completely behind the cover 11. Thereafter, the switching buttons 3 are used to operate the electronics product.

The closing operation of the door 20 is reverse to the opening operation thereof.

Briefly, when the opening and closing button 4 is operated as shown in FIG. 6D, the motor 51 is reversely driven to ascend the transfer unit 30. As the transfer unit 30 ascends, the door 20 which is connected to the transfer unit 30 ascends. Here, the guide protrusions 25 of the door 20 ascend along the guide elongate holes 13. The door 20 then passes through the positions shown in FIGS. 6B and 6C and moves up to the upper ends of the slant portions 14 of the guide elongate holes 13, and then stops as shown in FIG. 6D. Thus, the cover portion 23 which has been hidden at the rear side of the cover 11 ascends and is exposed to close the button portion 16 at the upper surface of the cover 11. Here, the cover portion 23 is flush with the cover 11 without any step difference, to close the buttons 3 again. The closing of the door 20 provides the same vertical surface as that of the cover 11.

Thus, the present invention improves the problems of generation of the step difference in the slide door apparatus which vertically moves up and down from the cover rear side in the prior art. That is, the present invention eradicates generation of the step difference, thereby the external design of the whole front panel of the consumer electronics product is highly graded.

While only a certain embodiment of the invention has been specifically described herein, it will be apparent that numerous modifications may be made thereto without departing from the spirit and scope of the invention.

What is claimed is:

1. The slide opening and closing door apparatus comprising:

a control box;

a door member which moves up and down, for opening and closing a front surface of said control box; and a power transmission unit for providing power to said door member to be moved, wherein said door member comprises a cover portion which moves up and down from a rear end of the cover of said control box for opening and closing said button portion of said control box and a transfer unit for receiving power and performing a transfer operation.

2. The slide opening and closing door apparatus according to claim 1, wherein said control box forms a covered space at a lower front surface and forms an exposed button portion at an upper surface.

3. The slide opening and closing door apparatus according to claim 2, wherein a guide elongate hole is formed at an inner wall in each side of said control box.

4. The slide opening and closing door apparatus according to claim 3, wherein said guide elongate holes each are slanted at a predetermined interval.

5. The slide opening and closing door apparatus according to claim 2, wherein said button portion forms a sliding surface at each side thereof.

6. The slide opening and closing door apparatus comprising:

a control box;

a door member which moves up and down, for opening and closing a front surface of said control box; and a power transmission unit for providing power to said door member to be moved, wherein said door member is sectioned into a door and a transfer unit both of which independently operate.

7. The slide opening and closing door apparatus according to claim 6, wherein said door moves up and down from a rear end of the cover of said control box in order to open and close a button portion.

8. The slide opening and closing door apparatus according to claim 7, wherein said door further comprises guide protrusions, a connection unit at a rear side of said door and a support plate which has a step difference.

9. The slide opening and closing door apparatus according to claim 6, wherein said transfer unit comprises connection units which are flexibly connected with said door; guide pieces which move up and down along said guide elongate holes; and rack gears which connect with pinion gears of said power transmission unit.

10. The slide opening and closing door apparatus according to claim 6, wherein said door and said transfer unit are connected by links, thereby forming a connection unit.

11. The slide opening and closing door apparatus according to claim 6, wherein said transfer unit descends and ascends in balance while contacting said door and further comprising elastic members for elastically supporting the bottom surfaces of the support plates.

12. The slide opening and closing door apparatus according to claim 6, wherein said door forms contact protrusions which contact a sliding surface of said button portion at its rear surface.

13. The slide opening and closing door apparatus according to claim 6, wherein said power transmission unit comprises a motor, a worm which is formed on the rotational shaft of said motor, worm gears which are engaged to said worm, idle gears which are engaged with said worm gears, and pinion gears which are engaged with said idle gears and with rack gears of the transfer unit.

14. The slide opening and closing door apparatus according to claim 6, wherein said control box forms a covered space at a lower front surface and forms an exposed button portion at an upper surface.

15. The slide opening and closing door apparatus according to claim 14, wherein said button portion forms a sliding surface at each side thereof.

16. The slide opening and closing door apparatus according to claim 14, wherein a guide elongate hole is formed at an inner wall in each side of said control box.

17. The slide opening and closing door apparatus according to claim 16, wherein said guide elongate holes each are slanted at a predetermined interval.

* * * * *